US006786246B2

(12) United States Patent
Ohms et al.

(10) Patent No.: US 6,786,246 B2
(45) **Date of Patent: *Sep. 7, 2004**

(54) METHOD AND APPARATUS FOR FILLING CARTRIDGES WITH A LIQUID

(75) Inventors: Rene Ohms, Bagsvaerd (DK); Flemming S. J. Manique, Ballerup (DK); Preben Kobbero, Hellerup (DK)

(73) Assignee: Novo Nordisk A/S, Bagsvaerd (DK)

( * ) Notice: Subject to any disclaimer, the term of this patent is extended or adjusted under 35 U.S.C. 154(b) by 0 days.

This patent is subject to a terminal disclaimer.

(21) Appl. No.: 10/713,135

(22) Filed: Nov. 14, 2003

(65) Prior Publication Data

US 2004/0094225 A1 May 20, 2004

Related U.S. Application Data

(63) Continuation of application No. 10/323,365, filed on Dec. 19, 2002, now Pat. No. 6,715,516.
(60) Provisional application No. 60/343,693, filed on Dec. 27, 2001.

(30) Foreign Application Priority Data

Dec. 19, 2001 (DK) ..... 2001 01907

(51) Int. Cl.[7] ..... B65B 31/00

(52) U.S. Cl. ..... 141/19; 141/2; 141/95; 141/198

(58) Field of Search ..... 141/19, 2, 5, 94, 141/95, 198, 192; 73/290 R, 293

(56) References Cited

U.S. PATENT DOCUMENTS

| | | | | |
|---|---|---|---|---|
| 3,094,213 | A | 6/1963 | Wyman | 209/524 |
| 3,452,208 | A | 6/1969 | Giltinan | 250/577 |
| 4,187,890 | A | 2/1980 | Stach et al. | 141/27 |
| 4,423,628 | A | 1/1984 | Richter | 73/290 R |
| 4,733,095 | A | 3/1988 | Kurahashi et al. | 250/577 |
| 4,880,039 | A | 11/1989 | Horak | 141/94 |
| 5,742,308 | A | 4/1998 | Cowger et al. | 347/85 |
| 5,819,816 | A | 10/1998 | Mayer | 141/83 |

FOREIGN PATENT DOCUMENTS

| | | |
|---|---|---|
| EP | 0 307 490 | 3/1989 |
| EP | 0 853 041 | 7/1998 |
| EP | 1 236 644 | 9/2002 |
| WO | 97/29954 | 8/1997 |

*Primary Examiner*—Gregory L. Huson
*Assistant Examiner*—Khoa D. Huynh
(74) *Attorney, Agent, or Firm*—Reza Green, Esq.; Richard W. Book; Marc A. Began

(57) ABSTRACT

An apparatus for filling a cartridge with a liquid comprises, a platform on which the cartridge is supported and which can be lifted relative to a stationary filling needle (5) so that this filling needle is moved into the cartridge (6), a pump (1) feeding liquid through the filling needle (5) into the cartridge (6), a sensor head (10) from which a beam of light is sent from one side of the cartridge to the other along a path immediately over an upper edge of the cartridge (6), and a reflector (11) reflecting the light beam back to the sensor head (10), which is connected to a sensor box (12) which produces a signal stopping the pump (1) and causing the needle (5) to be drawn out of the cartridge (6) when this cartridge is full and the liquid forms a droplet over the opening of the cartridge, which droplet deflects the light beam.

9 Claims, 1 Drawing Sheet

METHOD AND APPARATUS FOR FILLING CARTRIDGES WITH A LIQUID

CROSS REFERENCE TO RELATED APPLICATIONS

This application is a continuation of application Ser. No. 10/323,365 filed on Dec. 19, 2002 now U.S. Pat. No. 6,715,516 and claims priority under 35 U.S.C. 119 of Danish application no. PA 2001 01907 filed on Dec. 19, 2001 and U.S. provisional application No. 60/343,693 filed on Dec. 27, 2001, the contents of which are fully incorporated herein by reference.

BACKGROUND OF THE INVENTION

The invention relates to a method and an apparatus for topping up cartridges, which must be filled to their edge with a liquid and be closed by a sealing membrane leaving a minimum of air between the surface of the liquid and the sealing membrane.

A cartridge of this kind is a cylinder ampoule of the kind comprising a cylindrical tube which has a first and a second end, the first end being end closed by a piston and at the second end having a neck part terminated by a circumferential flange against which a rubber membrane is pressed sealingly by a cap having means gripping behind the flange. Such ampoules are commonly filled with a liquid medicine preparation and are used in pen shaped injection devices by which set doses of the preparation may be injected until the ampoule is empty.

The filling of the ampoules is performed in a sterile zone in which a number of operating stations are disposed. To perform the filling quickly and precise the filling is often made in three steps. First about 40% of the content is by a maximal speed filled into the ampoule, thereafter the next 40% is added more slowly to prevent formation of foam, and finally the ampoule is topped up relatively slowly with the last 20% of the liquid.

Especially the topping up step must be carried out carefully to ensure that the ampoule is totally filled before it is closed with the sealing membrane. This may be obtained by filling until an overflow is detected by using a filling head which presses a gasket against the upper edge of the ampoule, the gasket having two openings, a feeding opening through which the liquid is fed to the ampoule and an overflow opening through which excessive liquid leaves the cartridge when the cartridge is full. When overflow is detected the filling is stopped. Alternatively liquid is sprayed into the cartridge through a filling needle placed a short distance above the opening of the cartridge. A suction needle ends immediately over the opening of the ampoule and sucks away exceeding liquid when the cartridge is full and the liquid begins rise as a drop on the upper end of the cartridge. A liquid level monitor is established by placing a light source at the a flange established at the upper opening of the cartridge, against which flange a closing membrane can be sealed, when the cartridge has been filled. The light from the light source passes trough the flange and the space surrounded by the flange and into a sensor. When said space is filled with liquid the transmission parameters for the light beam are changed and the sensor senses this change and sends a signal, which stops the filling of the cartridge. During the time from the sensor detects the change in the transmitted light until the filling is actually stopped the rest of the ampoule is filled and sufficient extra liquid is delivered to rise the level sufficiently to ensure that the ampoule is totally filled which is indicated by liquid being sucked away though the suction needle.

SUMMARY OF THE INVENTION

It is an objective of the invention to provide a better topping up method by which waste of excessive liquid is reduced or eleminated and the formation of air bubbles is minimised.

A method according to the invention is characterised by the steps a) lowering a filling needle into the cartridge, b) feeding liquid through the filling needle into the cartridge, c) detecting when the cartridge is filled to its edge, d) stopping the liquid flow when the cartridge is detected as being full, e) lifting the filling needle out of the cartridge.

When the filling needle is lowered into the cartridge its tip is during the topping up placed in a smaller distance from the liquid surface in the cartridge or it even dips into the liquid from the initial filling process comprising one or two prefilling steps which are then succeeded by a topping up step.

The detecting at the edge may be obtained by passing a light beam immediately over the upper end of the cartridge and into a sensor. This way disturbance of the light beam due to irregularities in the glass flange is avoided. However, the liquid surface will inevitably rise over the edge of the cartridge as the stop signal to the pump is not sent until the detector detects such a rise. The liquid will rise as a drop only held by surface tension, but when the filling needle is lifted out of the cartridge the space which has been occupied by the needle will adopt the excessive amount of liquid forming the drop and the liquid level will fall to flush with the edge of the cartridge. This can be ensured by adjusting the distance the needle is lowered into the cartridge and the delay between the signal stopping the pump and the actual stopping of the filling.

When the filing needle is dips right into the liquid in the cartridge it is avoided that the jet of liquid from the filling needle entrains air into the liquid in the cartridge.

The invention further relates to an apparatus for performing the described method. Such an apparatus is characterised in that it comprises:

a filling needle which can be lowered to project into a cartridge, a controllable liquid feeding device, a detector detecting when the liquid level reaches the upper edge of the cartridge to control the feeding device to stop feeding liquid to the cartridge when a set upper level is reached, and a means for lifting the filling needle out of the cartridge when the filling is done.

BRIEF DESCRIPTION OF THE DRAWINGS

In the following the invention is further described with references to the drawing wherein.

DETAILED DESCRIPTION OF THE INVENTION

Figure 1:
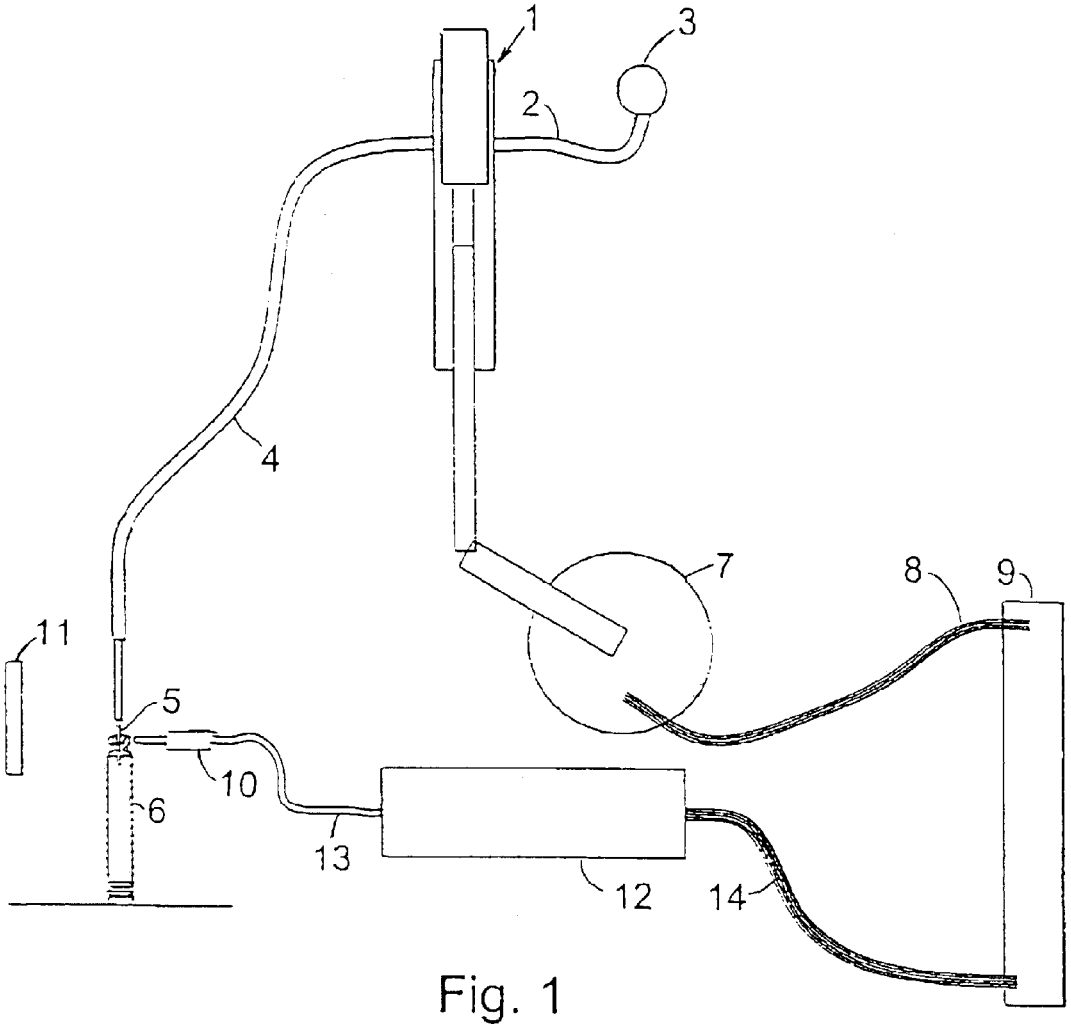
FIG. 1 shows schematically a filling station for ampoules.

FIG. 1 shows schematically a filling unit comprising a feeding pump 1 which through a suction tubing 2 is sucking liquid from an output manifold 3 on a liquid reservoir. The pump gives of the liquid through a filling tube 4 ending in a filling needle 5, which is in the figure lowered into an ampoule 6. The movement of the filling needle 5 relative to the ampoule may be obtained by lifting and lowering the ampoule relative to a stationary filing needle 5 but will in the following be described as a lowering and lifting of the filling needle 5. Ampoules are one by one passed to the filling position where they are filled and thereafter passed away two a closing station where they are sealed.

The pump is driven by an electric motor 7 which is energised through a cable 8. The energizing is controlled by a controller box 9 to make the pump 1 run through a filling sequence each time a new ampoule is placed in the filling position.

A sensor head 10 adjacent to the upper edge of the ampoule 6 surveys the filling of the ampoule when this ampoule is in its filling position with the filling needle 5 lowered into the ampoule. The position of the sensor head 10 is so that a light beam emerging from said sensor head passes immediately over the upper edge of the ampoule and past the lowered needle and hits a reflector 11 placed on the side opposite the sensor head 10 relative to the ampoule 6. From said reflector the light beam is reflected back to pass immediately over the upper edge of the ampoule past the lowered needle 5 and mainly into the sensor head 10. A light source producing the light for the light beam mentioned and a sensor detecting the reflected beam are placed in a sensor box 12 from which light is transmitted to the sensor head 10 and to which the reflected beam received by the sensor head 10 is transmitted through a light conducting cable 13. When the sensor in the sensor box 12 detects that the beam path from the sensor head 10 to the reflector 11 and back to the sensor head is disturbed by liquid rising over the upper edge of the cartridge, a signal is sent through a cable 14 to the control box which with a settable delay stops the motor 7 driving the pump 1. The settable delay makes it possible to control how far over the upper edge of the ampoule the liquid is allowed to rise.

The filling operation comprises the following steps:

1. An ampoule is placed in the filling position
2. the filling needle is lowered to project a settable distance into the ampoule,
3. a quick prefilling is performed in one or more steps,
4. a topping up is started during which the sensor head is active,
5. the topping up flow of liquid is with a settable delay stopped by the control box when the sensor detects the occurrence of a liquid drop rising over the upper edge of the ampoule and sends a signal to the control box,
6. the filling needle is lifted out of the ampoule and its insertion has been so adjusted that the amount of liquid displaced from the ampoule by the filling needle is the same as the amount of liquid in the drop rising over the upper edge of the ampoule. Consequently the lifting of the needle will make the liquid in the drop flow down into the ampoule so that the liquid surface is flush with the upper edge of the ampoule,
7. the ampoule is transported along to a not shown station in which it is closed and sealed.

Figure 2:
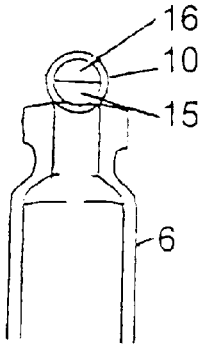
FIG. 2 shows the ampoule and a sensor head in FIG. 1 seen from the reflector.
Figure 3:
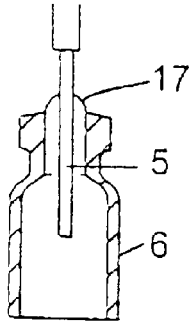
FIG. 3 shows the upper part of the ampoule with a submerged filling needle, and FIG. 4 the part shown in FIG. 3 with the filling needle drawn out of the liquid.
Figure 4:
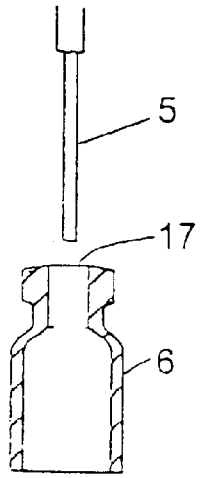

FIG. 2 shows a detail of the ampoule 6 and the sensor head 10 seen from the reflector. This illustrates how the light opening of the sensor head 10 is divided into a sending half 15 from which a light beam is sent towards the reflector 11 and a receiving half 16 receiving light reflected by the reflector. As it is seen the emitted light beam have to pass immediately over the upper edge of the ampoule 6 so that a drop of liquid can be detected as soon as the liquid level rises over said upper edge. The two halves 15 and 16 are each connected to a light transmission cable 13 which connects said halves with a sensor box 12 which contains a not shown light source from which light is transmitted to the sending half 15 of the sensor head 10, and a not shown sensor receiving light from the receiving half 16 of the sensor head 10. The sensor can be adjusted to react on a set change in the light received by the receiving half 16 to send a signal to the control box 12 which will then with a settable delay stop the motor 8 driving the pump 1. By varying the settable parameters the filling station can be adjusted to fill the ampoules and supply such an excessive amount of liquid that the drop formed by this excessive liquid practically corresponds exactly to the amount of liquid displaced by the part of needle 5 which is projecting into the ampoule, and the drop of excessive liquid, as it is sketched in FIGS. 3 and 4 which shows the upper part of the ampoule 6 with the filling needle 5 submerged in and drawn out of the liquid in the ampoule, respectively. To make this illustration more clearly the liquid surface is in these FIGS. 3 and 4 given the reference number 17.

The method and the function of the apparatus is described in connection with the filling and topping up of one single cartridge. In practice the apparatus has its place in a cartridge manufacturing line so that a cartridge after having been filled is passed further down the line and a new cartridge is placed in the filling station. Further more stations are placed parallel so that a number of cartridges are filled at the same time. The insertion and withdrawal of the filling needles are then made simultaneously but the filling itself is controlled individually for each cartridge.

We claim:

1. A method for filling a cartridge (6) with a liquid, characterised by the steps a) lowering a filling needle (5) into the cartridge (6), b) feeding liquid through the filling needle (5) into the cartridge (6), c) detecting when the cartridge (6) is filled to its edge, d) stopping the liquid flow when the cartridge (6) is detected as being full allowing an excessive amount of liquid to form a drop over at the edge of the cartridge (6), and wherein c) the detection comprises the following two steps:

c1) sending a beam of light from one side of the cartridge (6) to the other along a path immediately over an upper edge of the cartridge (6), and c2) reflecting the light beam back e) lifting the filling needle (5) out of the cartridge (6).

2. A method according to claim 1, characterised in that the filling step comprises a prefilling step and a topping up step.

3. A method according to claim 2, characterised in that the lowering of the filling needles (5) and the prefilling step is so adjusted, that the needle tip is below the surface (17) of the liquid when the topping up step is started.

4. A method according to claim 1, characterised in that a full cartridge is detected by changes in a light beam passing immediately over the upper edge of the cartridge (6).

5. A method according to claim any one of the preceding claims, characterised in that the topping up of the cartridge (6) is so adjusted that the amount of liquid exceeding the volume of the cartridge (6) and forming a drop over at the edge of the cartridge (6) corresponds to the amount of liquid displaced by the part of filling needle (5) projecting into the cartridge (6).

6. An apparatus for implementing the method for filling a cartridge (6) with a liquid, comprising b) means for controlled feeding of liquid through the filling needle (5) into the cartridge (6), c) means for detecting when the cartridge (6) is filled to its edge, and d) means for stopping the liquid flow when the cartridge (6) is detected as being full, wherein the means allows an excessive amount of liquid to form a drop over at the edge of the cartridge, characterised in that the apparatus further comprises a) means for lowering a filling needle (5) into the cartridge (6), and e) means for lifting the filling needle (5) out of the cartridge (6)

wherein c) the means for detection of a filled cartridge comprises a sensor head (10) from which a beam of light from a light source is sent from one side of the cartridge (6) to the other along a path immediately over an upper edge of the cartridge (6), and a reflector (11) reflecting the light beam back to the sensor head (10).

7. An apparatus according to claim 6, characterised in that the means for feeding liquid through the filling needle (5) into the cartridge (6) is a motor driven pump (1).

8. An apparatus according to claim 6, characterised in that the light source and a detector, which detects the light reflected from the reflector (11) back into the sensor head (10), are enclosed in a sensor box (12) and communicates with the sensor head (10) through light conductors.

9. An apparatus according to claim 6 characterised in that the motor (7) driving the pump (1) is energised from a control box (9) receiving signals from the sensor box (12).

* * * * *